US006814553B2

(12) United States Patent
Watanabe et al.

(10) Patent No.: US 6,814,553 B2
(45) Date of Patent: Nov. 9, 2004

(54) DUAL RECIPROCATING BELLOWS PUMP, WITH A PAIR OF INTERLOCKING SHAFTS PASSING THROUGH A COMMON PUMP HEAD AND DUAL PUMP CHAMBERS

(75) Inventors: Tsuyoshi Watanabe, Miyoshi-machi (JP); Tsutomu Sawada, Saitama-ken (JP); Toshiki Oniduka, Miyoshi-machi (JP)

(73) Assignee: Iwaki Co. Ltd., Tokyo (JP)

( * ) Notice: Subject to any disclaimer, the term of this patent is extended or adjusted under 35 U.S.C. 154(b) by 95 days.

(21) Appl. No.: 10/330,263

(22) Filed: Dec. 30, 2002

(65) Prior Publication Data

US 2004/0037722 A1 Feb. 26, 2004

(30) Foreign Application Priority Data

Aug. 23, 2002 (JP) ..... 2002-243011

(51) Int. Cl.[7] ..... F04B 45/02

(52) U.S. Cl. ..... 417/473; 417/441; 417/538; 417/507

(58) Field of Search ..... 417/401, 472, 417/473, 531, 538, 507, 441, 393, 394

(56) References Cited

U.S. PATENT DOCUMENTS 2,257,862 A * 10/1941 Sarver ..... 417/338
3,182,597 A * 5/1965 Malizard et al. ..... 417/339
3,659,971 A * 5/1972 Schottler ..... 417/538
5,141,412 A * 8/1992 Meinz ..... 417/473
5,224,841 A * 7/1993 Thompson et al. ..... 417/392
5,558,607 A 9/1996 Darling ..... 482/95
5,893,707 A * 4/1999 Simmons et al. ..... 417/393
6,059,546 A * 5/2000 Brenan et al. ..... 417/534

* cited by examiner

*Primary Examiner*—Justine R. Yu
*Assistant Examiner*—Emmanuel Sayoc
(74) *Attorney, Agent, or Firm*—Bacon & Thomas, PLLC; Felix J. D'Ambrosio

(57) ABSTRACT

The present invention is to provide a dual reciprocating bellows pump which can facilitate size reduction design of the whole pump, permit pump manufacture at low cost, and permit reducing the dead spaces in pumping chambers to provide improved self-suction performance.

Valve cases of suction side and discharge side valve units are disposed one below the other along a longitudinal axis passing through the center of the cross-section of the bellows such that they project into the associated pumping chambers, and a pair of interlock shafts are disposed at positions spaced apart to the left and right from the center in the transversal direction. With this construction, it is possible to reduce the dead spaces in the pumping chambers, reduce the longitudinal and transversal dimensions of the pump and facilitate size reduction design of the pump.

4 Claims, 3 Drawing Sheets

DUAL RECIPROCATING BELLOWS PUMP, WITH A PAIR OF INTERLOCKING SHAFTS PASSING THROUGH A COMMON PUMP HEAD AND DUAL PUMP CHAMBERS

BACKGROUND OF THE INVENTION

1. Field of the Invention

This Invention relates to a dual reciprocating bellows pump having dual cylindrical reciprocating bellows, which are capable of being expanded and contracted and defining pumping chambers for feed-to-pump fluid or pumped fluid such as semiconductor processing liquid, operating air being fed to the outside of the pumping chambers, and more particularly, to a dual reciprocating bellows pump, in which a pair of, i.e., left and right, bellows having the same structure are disposed on the opposite sides of a pump head and operated in an interlocked fashion by an interlock shaft means.

2. Description of the Prior Art

Dual reciprocating bellows pumps of this type are disclosed in U.S. Pat. Nos. 5,558,607 and 5,893,707. In these disclosed dual reciprocating bellows pumps, suction side and discharge side valve units are assembled as ball valve type unidirectional valves in a pump head disposed centrally of the pump, and a left side and a right side pumping chamber are defined by the pump head and pistons mounted on the movable ends of the left side and right side bellows, respectively. A left side and a right side operating air chamber for selectively feeding operating air thereto, are defined in the other regions of the bellows partitioned by the pistons. The pistons are mounted on the opposite ends of a single interlock shaft, and are used in unison therewith, whereby the left side and right side bellows undergo expansion and contraction to perform pumping operation.

In this construction, since the suction side and discharge side pump units are both assembled in the pump head, the size of the pump head, particularly the thickness or transversal size thereof, is inevitably large, thus posing a problem that it is difficult to design size reduction of the pump as a whole. In the case of using the pump as, for instance, a circulation pump for feeding semiconductor processing liquid, materials excellently corrosion- and chemical-resistant such as fluorine resins are desirably used for pump portions to be in contact with the liquid. Such materials are considerably expensive, thus leading to a demand for pump size reduction as much as possible for material expenditure saving. The above construction, however, can not sufficiently meet this demand.

In a different construction of the pertaining prior art pump, an interlock shaft means is movably disposed outside the pumping chambers, and the left side and right side bellows are coupled to the interlock shaft means for interlock operation to each other. In this case, however, it is necessary to provide a space for supporting the interlock shaft means and related structure part in the pump housing. Therefore, the size of the pump housing, and hence the size of the pump as a whole, is inevitably increased, and as in the above case the problem that it is difficult to reduce the pump size is posed.

The invention was made in view of the above various problems inherent in the prior art bellows pumps, and thus it is an object of the invention to provide a dual reciprocating bellows pump, which can facilitate size reduction design of the whole pump and reduce cost of manufacture by material expenditure saving.

It is another object of the invention to provide a dual reciprocating bellows pump, which can reduce the dead spaces in the pumping chambers to prevent undesired residence or stay of feed-to-pump fluid in the pumping chambers and also has improved self-suction performance.

SUMMARY OF THE INVENTION

To attain the above objects of the invention, the invention proposes a dual reciprocating bellows pump, in which a left side and a right side cylindrical bellows are sealedly mounted on the opposite sides of a pump head, end members are sealedly coupled to the other free ends of the bellows and define pumping chambers for feed-to-pump fluid or pumped fluid inside the bellows while also defining operating air chambers together with the outer side of the bellows and the pump housing, and interlock shaft means for interlocking the left side and right side bellows movably or slidably penetrates the pump head to project or extend into the left side and right side pumping chambers and be operatively engaged with the inner surfaces of the associated end members, thereby interlocking the two bellows for the performance of pumping operation.

The dual reciprocating bellows pump according to the invention particularly has a construction comprising a pump housing, a pump head assembled in the pump housing and having a suction port and a discharge port for sucking and discharging feed-to-pump fluid, respectively, a pair of, i.e., left side and right side, cylindrical bellows having stem portion sealedly mounted on opposite sides of the pump head and reciprocal in the pump housing with a predetermined stroke of expansion and contraction along the longitudinal axis of the pump housing, end members each sealedly coupled to the free end of each of the bellows and co-operative with the bellows to define a pumping chamber inside the bellows and also define an operating air chamber together with the bellows and pump housing; an operating air feed-in means communicating with the left side and right side operating air chambers provided in the housing for selectively feeding operating air to either of said paired operating air chambers, interlock shaft means interlocked to the reciprocation of one of said paired bellows for causing reciprocation of the other bellows, suction side valve units mounted on the pump head and each disposed as a unidirectional valve between said suction port and each pumping chamber for allowing in-flow of feed-to-pump fluid from the suction port to the pumping chamber, and discharge side valve units mounted on the pump head and each disposed as a unidirectional valve between said discharge port and each pumping chamber for allowing out-flow of the feed-to-pump fluid from the pumping chamber to the discharge port; said valve units each having a valve case and a valve member movably supported therein;

wherein: said valve cases of the suction side and discharge side valve units are disposed below and above a center of the cross-section of the cylindrical bellows and project into the associated pumping chamber; said interlock shaft means is constituted by a pair of interlock shafts movably penetrating the pump head in the longitudinal axial direction, and each of said interlock shafts having one end projecting in one of the pumping chambers and operatively engaged with the inner surface of the associated end member and the other end projecting in the other pumping chamber and operatively engaged with the inner surface of the associated end member, the two interlock shafts being disposed at a left side and a right side position, respectively, spaced apart from the center of the cross-section of the cylindrical bellows.

In the above arrangement according to the invention, the pair of interlock shafts constituting the interlock shaft means and projecting via the pump head into the left side and right side pumping chambers, are disposed at positions spaced apart to the left and right, respectively, from the center position of the bellows, and the valve cases of the suction side and discharge side valve units are disposed below and above the center and project into the pumping chambers. The two valve cases and the interlock shafts thus greatly contribute to the solution of the problem of the so-called "dead spaces" in the pumping chambers. It is thus possible to reduce the phenomenon of undesired residence or stay of feed-to-pump fluid in the pumping chambers as much as possible and obtain improved self-suction performance.

Also, since the two valve cases are not assembled inside the pump head, it is possible to reduce the thickness or transversal size of the pump head. Furthermore, since the paired interlock shafts are disposed at the positions spaced apart to the left and right from the center position of the bellows, it is possible to facilitate size reduction design of the whole pump and also reduce material expenditures of synthetic resins or the like of the pump so as to permit pump manufacture at reduced cost. Still further, since the valve size can be increased as much as possible, it is possible to provide a highly efficient pump with reduced pressure loss.

Further, since the paired interlock shafts are provided as the interlock shaft means, unlike the single interlock shaft, in which forces pushing the end member of the associated bellows are concentrated at one point thereby to exert excessive force onto the end members, the pushing forces are distributed, and it is thus possible to prevent such excessive force onto the end members thereby to reduce the thickness of the end members for correspondingly saving material expenditures and permitting ready coping with faster operation owing to the bellows weight reduction.

In another preferred arrangement of the present invention, the invention seeks to provide a dual reciprocating bellows pump, which, regarding the valve cases of the suction side and discharge side valve units disposed one below the other, each valve case of each discharge side valve unit is disposed at an upper position while each valve case of each suction side valve unit is disposed at a lower position spaced apart by a distance along the vertical axis passing through the center noted above. Also, the paired interlock shafts are disposed in line symmetry with respect to the transversal axis passing through the center, and the distance noted above is set to be less than the diameter of the interlock shafts.

With the above arrangement, it is possible to further reduce the vertical size of the pump while providing a sufficiently large size of the combination of the upper and lower valve units. Besides, with the line symmetrical disposition of the paired interlock shafts, stabler pump operation is obtainable, because both interlock shafts can engage the corresponding end members in good balanced positions. Furthermore, with the discharge side valve units disposed at the upper position, air bubbles can be smoothly discharged from the pumping chambers.

In a further preferred arrangement of the present invention, the invention seeks to provide a dual reciprocating bellows pump, in which, concerning the operative coupling between the paired interlock shafts constituting the interlock shaft means and the end members of the associated bellows, the ends of the interlock shafts are in contact engagement with the inner surfaces of the end members.

With this arrangement, no particular means is necessary for mounting the interlock shafts onto the end members of the bellows, and also in the assembling of the interlock shafts in the pump, the assembling operation can be simply completed by merely inserting the interlock shafts through the pump head. Thus, it is possible to increase the efficiency of the assembling operation and reduce cost thereof.

BRIEF DESCRIPTION OF THE DRAWINGS

These and other objects, features and advantages of the invention will become more apparent upon reading of the following detailed description when the same is read with reference to the accompanying drawings, in which.

DETAILED DESCRIPTION OF THE PREFERRED EMBODIMENTS

Figure 1:
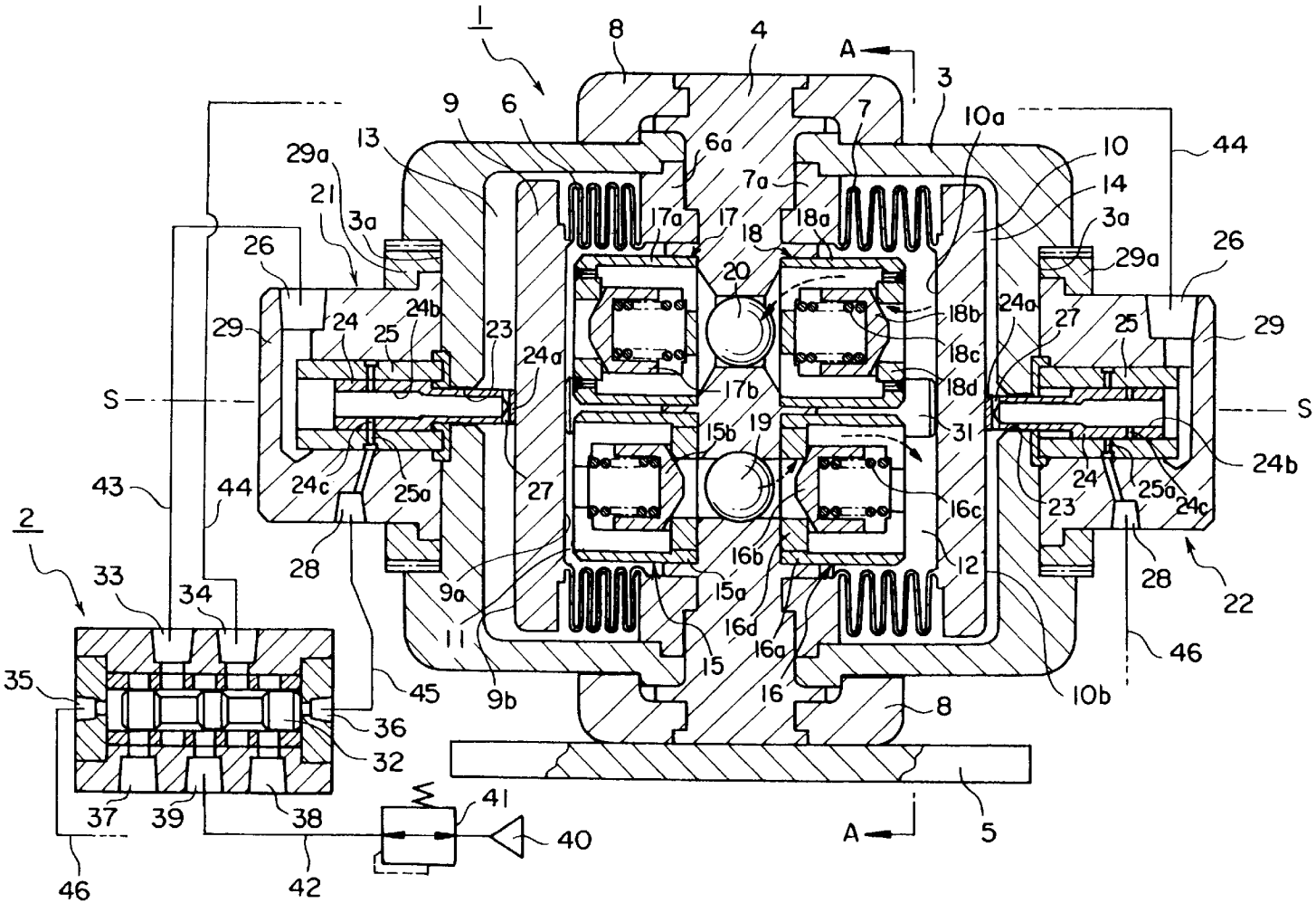
FIG. 1 is an elevational sectional view showing a pump system including a dual reciprocating bellows pump embodying the invention and an accessory control valve.

A preferred embodiment of the dual reciprocating bellows pump according to the invention will now be described with reference to the drawings. FIG. 1 shows the construction of a pump system, which includes a dual reciprocating bellows pump 1 according to the invention and an accessory control valve 2.

The dual reciprocating bellows pump 1 comprises a pump housing 3, a pump head 4, a base 5 supporting the pump head 4 upright, and a pair of, i.e., left and right, cylindrical bellows 6 and 7, which are disposed in the pump housing 3 on the opposite sides of the pump head 4 for expansion and contraction along a horizontal longitudinal axis S—S. The pump housing 3 has a frame structure constituted by two halves disposed on the opposite sides of the pump head 4 and assembled by assembling rings 8 thereto. As shown in the Figure, the pump is used in a state that the pump head 4 is supported upright on the base 5 and that the left and right bellows 6 and 7 are reciprocal in the horizontal longitudinal axis S—S.

The bellows 6 and 7 have their respective stem portions 6*a* and 7*a* sealedly mounted on the opposite sides of the pump head 4, such that they extend therefrom in the cantilever fashion along the longitudinal axis S—S. Disc-like end members 9 and 10 are sealedly coupled to the free ends of the bellows 6 and 7. Specifically, in this embodiment the end members 9 and 10 are made integral with the bellows 6 and 7, respectively. The end members 9 and 10 are held upright, i.e., perpendicular to the long axis S—S, and undergo parallel movement with expansion and contraction of the bellows 6 and 7.

Inside the bellows 7 and 8, pumping chambers 11 and 12 are defined by the pump head 4 and the end members 9 and 10. Outside the bellows 7 and 8, operating air chambers 13 and 14 are defined by the pump housing 3 and the pump head 4. Inside the pumping chambers 11 and 12, suction side valve units 15 and 16 and discharge side valve units 17 and 18 are disposed, and they are mounted on the opposite sides of the pump head 4 such that they are communicated with a suction port 19 and a discharge port 20 provided in the pump head 4. With the discharge port 20 disposed above the suction port 19 as in this embodiment, air bubbles generated in the pumping chambers 11 and 12 can be readily discharged through the discharge port 20.

The left and right suction side valve units 16 and 17 have the same structure and are disposed in line symmetry with respect to the pump head 4. One of these valve units, i.e., the right side valve unit 16 will be described in detail. This valve unit 16 is a unidirectional control valve having a valve case 16*a* and a poppet-type valve member 16*b* movably supported in the valve case. The valve member 16*b* is biased by a coil spring 16*c* such that it is normally held in a valve closing position as shown in engagement with a valve seat 16*d*. When the pumping chamber 12 becomes under negative pressure to allow feed-to-pump fluid or pumped fluid to flow via the suction port 19 into the pumping chamber 12, the valve member 16*b* is moved against the biasing force of the coil spring 16*c*, thus opening the valve and allowing in-flow of the feed-to-pump fluid as shown by arrow in FIG. 1 while blocking out-flow of the fluid from the pumping chamber 12 to the suction port 19. The other valve unit 15 has the same structure as described, having a valve case 15*a* and a valve member 15*b*.

The left and right discharge side valve units 17 and 18 have the same structure and are disposed in line symmetry with respect to the pump head 4. One of these valve units, i.e., the right side valve unit 18, will be described in detail. This valve unit 18 is a unidirectional control valve having a valve case 18*a* and a pipet-type valve member 18*b* movably supported in the valve case 18*a*. The valve member 18*b* is biased by a coil spring 18*c* such that it is normally held in a valve closing position as shown in engagement with a valve seat 18*d*. At the time of out-flow of the feed-to-pump fluid from the pumping chamber 12 to the discharge port 20, the valve member 18*b* is moved against the biasing force of the coil spring 18*c*, thus opening the valve and allowing out-flow of the feed-to-pump fluid as shown by arrow in the Figure while blocking in-flow of the fluid from the discharge port 20 into the pumping chamber 20. The other valve unit 17 has the same structure as described, having a valve case 17*a* and a valve member 17*b*.

Switching mechanisms 21 and 22 are mounted on the outer side of the pump housing 3 at the opposite ends thereof along the longitudinal axis S—S. Each of the switching mechanisms 21 and 22 includes a hollow detection rod 24 having an end portion 24*a* extending through an opening 23 in the pump housing 3 into the operating air chamber 13 or 14, a cylinder 25 supporting the rod 24 such as to be slidable therein, and a body 29 supporting the cylinder 25 and having an operating air feed-in port 26 communicating with the free end of the cylinder 25. In each of the switching mechanisms 21 and 22, operating air entering from the operating air feed-in port 26 is fed through an axial bore 24*b* formed in the rod 24 and also a transversal hole 27 formed in an end 24*a* of the rod 24 to the corresponding operating air chamber 13 or 14. The switching mechanisms 21 and 22 thus constitute an operating air feed-in means. In each of the switching mechanisms 21 and 22, the body 29 is detachably mounted via a mounting ring 29*a* on the pump housing 3. Each mounting ring 29*a* is fitted by, for instance, screwing it in a mounting recess 3*a* formed in the pump housing 3. Thus, the switching mechanisms 21 and 22 can be readily assembled. Also, the switching mechanisms 21 and 22 can be removed from the pump housing 3 by merely removing their mounting ring 29*a* for their ready maintenance operation.

In each of the switching mechanisms 21 and 22, the detection rod 24 has a transversal hole 24*c* communicating with the axial bore 24*b*, while the cylinder 25 has a transversal hole 25*a* communicating with a pilot air supply port 28 formed in the body 29. The end 24*a* of the detection rod 24 extends into the corresponding operating air chamber 13 or 14, and contacts or operatively engages the outer surface of the associated end member 9 or 10. The detection rod 24 undergoes sliding movement in the cylinder 25 with movement of the end member 9 or 10, i.e., reciprocating movement of the bellows 6 or 7. As shown in FIG. 1, when the left side bellows 6, for instance, reaches one end position of its stroke, i.e. the final compressed position of the stroke, the hole 24*c* of the detection rod 24 reaches a position to communicate with the hole 26*a* in the cylinder 25. As a result, operating air is allowed to partly branchedly flow out through the two holes 24*c* and 25*a* to the pilot air flow-out port 28. The right side bellows 7 and end member 10 and the associated detection rod 24 are of the same structures. When the associated bellows 6 or 7 undergoes expansion, the detection rod 24 is pushed by the associated end member 9 or 10 and retreated into the corresponding cylinder 25. With the contraction of the bellows, on the other hand, the detection rod 24 is this time advanced toward the corresponding operating air chamber 13 or 14 while it is kept in contact with the associated end member 9 or 10 which is pushed by entering operating air.

The left and right side bellows 6 and 8 are reciprocally moved in an interlocked relation to each other, and this movement is brought about by the pair of interlock shafts 30 and 31 constituting the interlock shaft means. Specifically, the interlock shafts 30 and 31 movably penetrate the pump head 4 along the longitudinal axis S—S such that each of both shafts has one end portion projecting or extending into the pumping chamber 11 and operatively coupled by contact engagement with the inner surface 9*a* of the corresponding end member 9 and the other end portion projecting or extending into the other pumping chamber 12 and operatively coupled by contact engagement with the inner surface 10*a* of the corresponding end member 10. The paired interlock shafts 30 and 31 are particularly shown in FIGS. 2 and 3. The two or dual bellows 6 and 7 are thus interlocked to each other such that with the reaching of one end position in the stroke by the bellows 6 as shown in FIG. 1, the other bellows 7 reaches the other end position in the stroke, and vice versa. The interlock shafts 30 and 31 are inserted through the pump head 4 with an adequate clearance provided relative thereto so that no excessive resistance will be offered to them while they are reciprocally moved through the pump head 4.

In this embodiment, the structure that the interlock shafts 30 and 31 are operatively coupled to the end members 9 and 10 with their ends contact engaged with the inner surfaces of the end members, has been described as the most desirable structure. Alternatively, it is possible to adopt, for instance, a structure, in which the interlock shafts are directly coupled or fixed to the end members such that they each have opposite end secured by screwing or like means to the corresponding end member and the other end inserted through a hole, which is formed in the other end member, and adequately secured in this inserted portion. At any rate, with the two interlock shafts 30 and 31 disposed in the pumping chambers 11 and 12, the so-called dead spaces in the pumping chambers can be correspondingly reduced to reduce undesired residence or stay of feed-to-pump fluid in the pumping chambers. Thus, it is possible to obtain a pump having improved self-suction performance.

The control valve 2 is constituted by a spool valve which has a spool 32 disposed in the inside, a pair of operating air supply ports 33 and 34, a pair of pilot air feed-in ports 35 and 36, a pair of air exhaust ports 37 and 38 and an operating air feed-in port 39. The operating air feed-in port 39 is connected via a duct line 42 to a pressure regulator 41 and thence to an operating air source 40. The paired operating air supply ports 33 and 34 are connected via duct lines 43 and 44 to the left and right side operating air feed-in ports 26, respectively, of the bellows pump 1. The paired pilot air feed-in ports 35 and 36 are connected via duct lines 45 and 46 to the left and right side pilot air supply ports 28, respectively, of the bellows pump 1.

In dependence on the position of the spool 32, the paired operating air supply ports 33 and 34 are selectively communicated with the operating air feed-in port 39, whereby operating air is fed to either one of the left and right side pumping chambers 13 and 14 of the bellows pump 1. The movement of the spool 32 is brought about by pilot pressure by branched air flows from the pilot air supply ports 28 in the left side and right side switching mechanisms 21 and 22 to the pilot air feed-in ports 35 and 36. More specifically, when the left side bellows 6, for instance, reaches one of the end positions of the stroke, i.e. the final compressed position of the stroke as shown in FIG. 1, branched air flow is caused from the associated switching mechanism 21 to the pilot air feed-in port 36 to cause the spool 32 to be moved to the left, thus blocking the communication of the operating air supply port 33 while opening the other operating air supply port 34 to feed operating air to the operating air chamber 14 on the side of the other bellows 7. The air exhaust ports 37 and 38 serve the role that when operating air is fed from one of the operating air supply ports 33 and 34 to the associated operating air chamber 13 or 14, they allow discharge of air from the other operating air chamber. This function is necessary for the expansion and contraction of the bellows 6 and 7.

Figure 2:
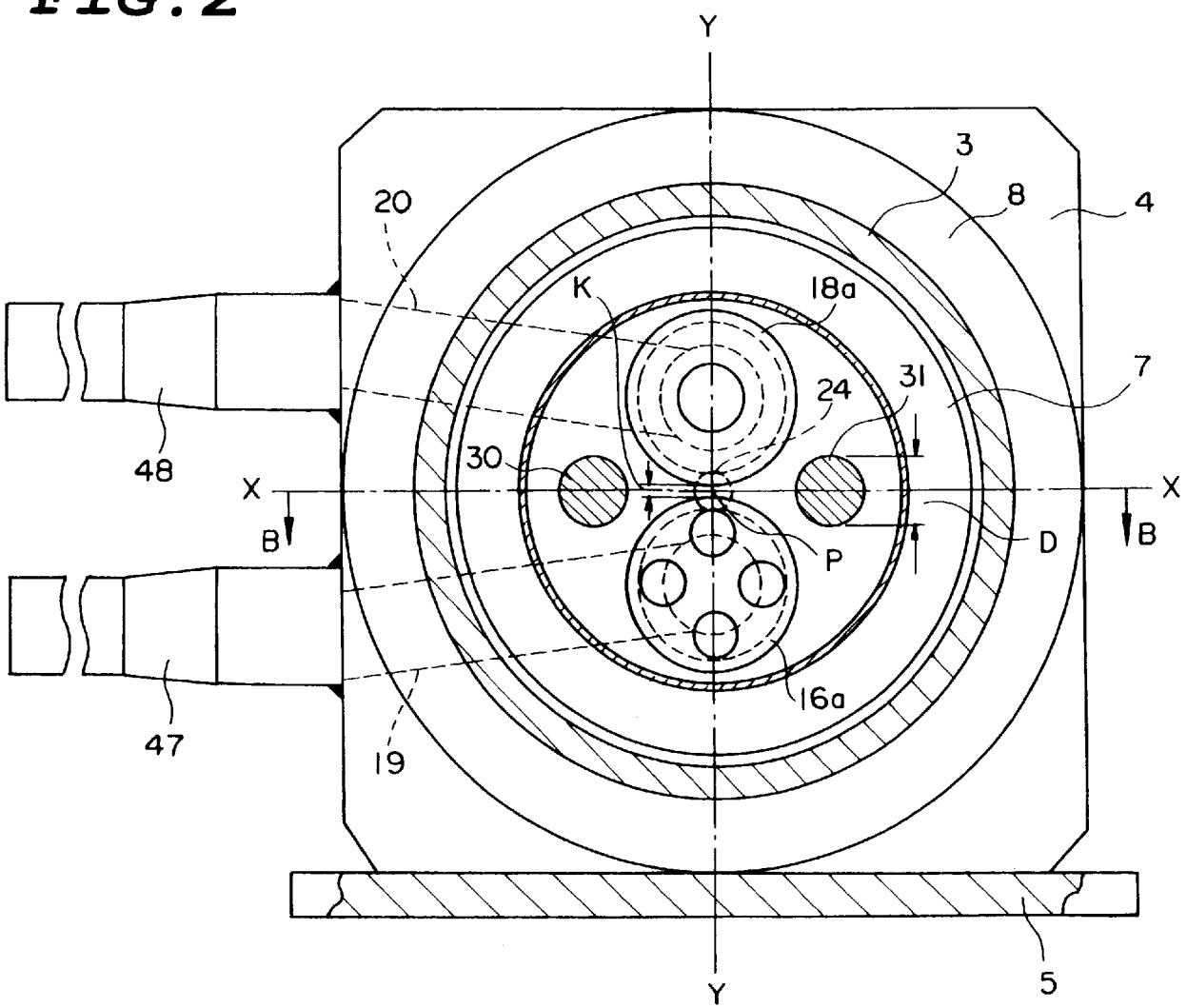
FIG. 2 is a side sectional view taken along line A—A in FIG. 1.
Figure 3:
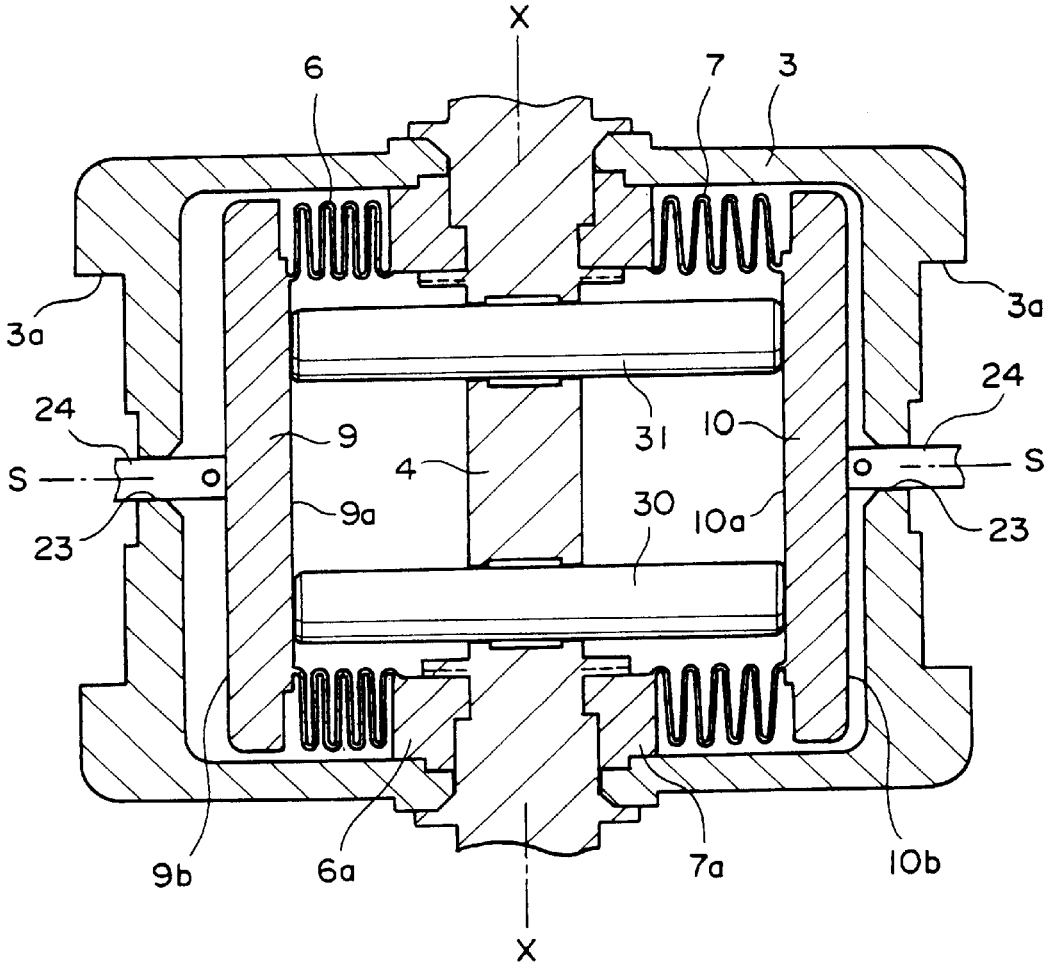
FIG. 3 is a horizontal sectional view taken along line B—B in FIG. 2.

As shown above, the control valve 2 switches supply of the operating air to the operating air chambers 13 and 14 in the left and right side bellows 6 and 7 by pilot pressure selectively received from either switching mechanism 21 or 22. In this way, both of the left and right side bellows 6 and 7 are reciprocated by means of the two interlock shafts 30 and 31 to let feed-to-pump fluid be fed to one of the pumping chambers 11 and 12 and fed out from the other pumping chamber. This operation is repeated for the execution of the pump operation. As shown in FIG. 2, the suction port 19 and the discharge port 20 are communicated with a take-in and a take-out tube 47 and 48, respectively, attached to the pump head 4 at each end thereof.

The feed-to-pump fluid may be a processing liquid for processing semiconductor wafers, and in this case the pump 1 is used as a circulation pump in a semiconductor wafer manufacturing process or the like. As the operating air, ordinary air or other gases may be used in dependence on the purposes. In the case of using semiconductor wafer processing liquid or like liquid as the feed-to-pump fluid, materials which are richly chemical- and corrosion-proof, such as fluorine resins, are desirably used for component parts of the bellows to be in contact with the liquid.

In this embodiment, the left and right side switching mechanisms 21 and 22 have been shown to have a structure that they also serve as the operating air feed means. As an alternate structure, it is also possible to provide the pump housing 3 with separate operating air feed-in ports communicating, as operating air feed means, with the operating air chambers 13 and 14 respectively. In this case, branched operating air for detection of the end bellows stroke position by the detection rods 23 and 24 maybe fed from the corresponding operating air chambers 13 and 14.

This embodiment of the dual reciprocating bellows pump, as shown in FIG. 1, has a line symmetrical structure with respect to the pump head 4, with the paired bellows 6 and 7 and related parts constructed to have the same structures. The arrangement of this embodiment of the invention will be described in greater details mainly in connection with the right side bellows 7 and the related parts.

In the pumping chamber 12, the suction side and discharge side valve units 16 and 18 are disposed such that the former is below and the latter is above. The valve cases 16*a* and 18*a* of these valve cases 16 and 18 are cylindrical and, as shown in FIG. 2, disposed above and below the center P of the cross-section of the cylindrical bellows 7. Particularly, in this embodiment the valve cases 18*a* and 16*a* of the discharge side and suction side valve units 18 and 16 project into the pumping chamber 12, with the valve case 18*a* being disposed above, and the valve case 16*a* being disposed below the valve case 18*a* at a close distance K therefrom along the vertical axis Y—Y as shown in FIG. 2. This means that the upper and lower valve cases 18*a* and 16*a* extend vertically in the associated pumping chamber 12 to an extent nearly corresponding to the inner diameter size of the bellows 7. It is thus possible to increase the flow opening of the valve and reduce the pressure loss in the valve part as much as possible. Also, as shown in FIG. 1, the upper and lower valve cases 18*a* and 16*a* extend longitudinal in the pumping chamber 12 along the longitudinal axis S—S.

Since the upper and lower valve cases 18*a* and 16*a* as well as the pair of interlock shafts 30 and 31 as noted above extend longitudinal in the pumping chamber 12 as described above, it is possible to further reduce the so-called dead space in the pumping chamber 12, thus reducing undesired residence or stay of the feed-to-pump fluid in the pumping chamber and obtain improved self-suction performance of the pump. Since the valve cases 18*a* and 16*a* can be large in size as described above, it is possible to provide large areas of the flow openings of the valve units 16 and 18, thus reducing the pressure loss in the valve unit regions as much as possible.

The pair of interlock shafts 30 and 31 as the interlock shaft means, as shown in FIG. 2, are each disposed at each of a left and a right position spaced apart from and on the opposite sides of the center P of the cross-section of the bellows 7. Particularly, in this embodiment the two interlock shafts 30 and 31 are disposed on a left and a right position spaced apart from the center P along the lateral or horizontal axis X-X passing through the center P. With this structure, the ends of the two interlock shafts 30 and 31 are in contact engagement at two positions with the inner surface 10*a* of the associated end member 10. Thus, unlike the case of the single shaft structure in engagement at a single position with the associated end member, a thinner end member may suffice owing to the dispersion of the pushing force exerted to the end member. Consequently, it is possible to realize smoother and faster bellows operation. Besides, since the pair of interlock shafts 30 and 31 are in line symmetry with each other, improved balance of the engagement relation of the interlock shaft ends and the associated end member to one another is obtainable, and it is thus possible to obtain much stabler pumping operation.

As shown above, since the paired interlock shafts 30 and 31 as the interlock shaft means are disposed at positions spaced apart to the left and right, respectively, from the center P and not disposed between the two valve cases 16*a* and 18*a*, it is possible to increase the valve case size, and with a constant valve case size it is possible to reduce the vertical size of the whole pump. Thus, with the construction that the valve cases are not completely installed within the pump head 4 but project into the pumping chambers as described above, it is possible to reduce the thickness and the lateral size of the pump head, and it is also possible to facilitate the size reduction design of the whole pump and reduce the manufacturing cost by saving the materials used. Particularly, since in this embodiment the two valve cases are disposed close to each other such that the distance K between them is less than the diameter D of the interlock shafts, it is possible to permit pump design with further reduced vertical size.

According to the invention the distance K between the upper and lower valve cases maybe zero as well. In other words, the invention is applicable to the case, in which the two valve cases are in contact or integral with each other.

The valve cases 18*a* and 16*a* are desirably cylindrical as in this embodiment, but they may be of other shapes as well. The interlock shafts 30 and 31 are formed as round rod like shape, but they may have any desired shape such as rectangular sectional shape. In this case of the rectangular sectional shape, the dimension D is the size measured vertically.

In this embodiment, the end portions 24*a* of the detection rods 24 in the left side and right side switching mechanisms 21 and 22 are disposed at positions in contact engagement with the center P of the outer surfaces 9*a* and 10*b* of the associated end members 9 and 10. However, this arrangement is by no means limitative so long as the detection rods 24 can be interlocked to the associated end members 9 and 10.

While a preferred embodiment of the dual reciprocating bellows pump according to the invention has been described, the arrangement of this embodiment is by no means limitative. For example, while in this embodiment the upper and lower valve cases are disposed along the vertical axis Y—Y passing through the center P of the bellows while disposing the pair of, i.e., left side and right side interlock shafts along the lateral axis X—X passing through the center P, the invention also covers an arrangement, in which the vertical and lateral axes are slightly deviated from the center, and also those, in which the vertical and lateral axes Y—Y and X—X are tilted or rotated.

As has been described in the foregoing, according to the invention, with the disposition of the valve cases of the suction side and discharge side valve units such that they project into the pumping chambers with the former below the latter and also with the disposition of the dual interlock shafts in the transversal direction, the dead spaces in the pumping chambers can be greatly reduced, and undesired residence or stay of the feed-to-pump fluid in the pumping chambers can be effectively prevented, and it is possible to obtain a bellows pump having improved self-suction performance. With the above arrangement, it is possible to obtain various effects such as that the pump size can be reduced not only in the vertical direction but also in the longitudinal direction, that reduced size pump design can be extremely facilitated and that the material expenditures for the pump parts materials can be saved to realize pump manufacture at reduced cost.

What is claimed is:

1. A dual reciprocating bellows pump comprising:

a pump housing;

a pump head assembled in the pump housing and having a suction port and a discharge port for sucking and discharging feed-to-pump fluid, respectively;

a pair of left side and right side, cylindrical bellows having stems sealedly mounted on opposite sides of the pump head and reciprocal in the pump housing with a predetermined stroke of expansion and contraction along a longitudinal axis (S—S) of the pump housing;

end members each sealedly coupled to the free end of each of the bellows and co-operative with the bellows to define a pumping chamber inside the bellows and also define an operating air chamber together with the bellows and the pump housing;

operating air feed-in means communicating with the left side and right side operating air chambers provided in the housing for selectively feeding operating air to either one of said paired operating air chambers;

interlock shaft means interlocked to the reciprocation of one of said paired bellows for causing reciprocation of the other bellows;

suction side valve units mounted on the pump head and each disposed as a unidirectional valve between said suction port and the corresponding pumping chamber for allowing in-flow of feed-to-pump fluid from the suction port to the corresponding pumping chamber; and discharge side valve units mounted on the pump head and each disposed as a unidirectional valve between said discharge port and the corresponding pumping chamber for allowing out-flow of the feed-to-pump fluid from the corresponding pumping chamber to the discharge port;

each of said valve units each having a valve case and a valve member movably supported therein;

wherein:

said valve cases of the suction side and discharge side valve units are disposed below and above a center (P) of the cross-section of the cylindrical bellows and project into the associated pumping chamber;

said interlock shaft means is constituted by a pair of interlock shafts movably penetrating the pump head in the longitudinal direction (S-S) and each has one end projecting in one of the pumping chambers and operatively engaged with the inner surface of the associated end member and the other end projecting in the other pumping chamber and operatively engaged with the inner surface of the associated end member, the paired interlock shafts being disposed at a left side and a right side position, respectively, spaced apart from the center (P) of the cross-section of the cylindrical bellows.

2. The dual reciprocating bellows pump according to claim 1, wherein:

said valve case of said discharge side valve unit is disposed at an upper position while said valve case of said suction side valve unit is disposed at a lower position spaced apart from the suction side valve unit by a distance K along a vertical axis (Y—Y) passing through the center (P);

said paired interlock shafts are disposed in line symmetry with respect to a transversal axis (X-X) passing through the center (P); and the distance (K) is less than the diameter (D) of the interlock shafts.

3. The dual reciprocating bellows pump according to claim 1, wherein the paired interlock shafts have their ends operatively coupled by contact engagement to the inner surfaces of the associated end members.

4. The dual reciprocating bellows pump according to claim 2, wherein the pair interlock shafts have their ends operatively coupled by contact engagement to the inner surfaces of the associated end members.

* * * * *